United States Patent [19]

Ishida

[11] 4,136,409

[45] Jan. 30, 1979

[54] DRESSING-UNDRESSING APPARATUS

[75] Inventor: Michiyasu Ishida, Nagaokakyo, Japan

[73] Assignee: Mitsubishi Jukogko Kabushiki Kaisha, Toyko, Japan

[21] Appl. No.: 875,085

[22] Filed: Feb. 3, 1978

[30] Foreign Application Priority Data

Feb. 4, 1977 [JP] Japan ..... 52-11668[U]

[51] Int. Cl.[2] ..... A61G 7/00

[52] U.S. Cl. ..... 5/91; 5/60; 5/317 R

[58] Field of Search ..... 5/60, 90–92, 5/317 R, 352, 357

[56] References Cited

U.S. PATENT DOCUMENTS

| | | | |
|---|---|---|---|
| 1,040,795 | 10/1912 | Skeffington | 5/91 |
| 2,559,956 | 7/1951 | Hay et al. | 5/91 |
| 3,822,425 | 7/1974 | Scales | 5/91 |
| 3,886,610 | 6/1975 | Shelden | 5/91 |

*Primary Examiner*—Casmir A. Nunberg
*Attorney, Agent, or Firm*—Sherman Levy

[57] ABSTRACT

A dressing-undressing apparatus helps a nurse to dress and undress a patient or disabled person lying on the bed, by selectively lowering one of mattress elements constituting the bed in response to the movement of one arm of the nurse.

3 Claims, 8 Drawing Figures

DRESSING-UNDRESSING APPARATUS

This invention relates to a dressing-undressing apparatus helpful for a nurse in dressing and undressing an invalid, especially a bedridden patient.

Usually, when a bedridden patient is to take a bath or change into clean cloths, he must depend on some other person for assistance in taking off his cloths and redressing afterwards. This is such hard labor for one attendant only that the latter does the work with much liability of back strain. In addition to the back problem, it involves many other difficulties to be overcome.

The present invention has for its object the provision of a dressing-undressing apparatus which permits one nurse alone with ease to dress and undress a patient confined to bed and quite unable to move himself.

Figure 7:
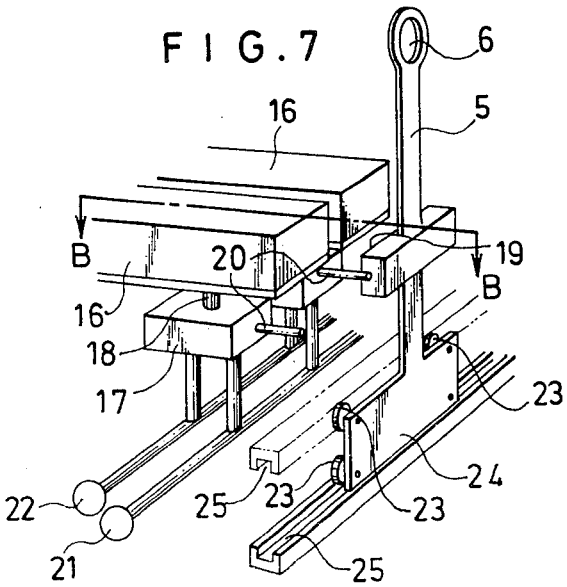
Figure 8:
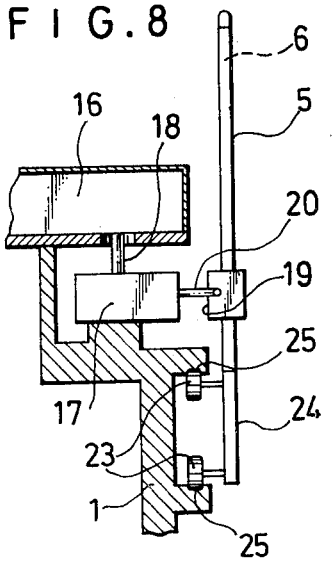

FIGS. 6(I) and (II) are side views of mattress element with modified forms of plate to serve as part of track for weight rollers;

FIG. 7 is a perspective view of another embodiment of the dressing-undressing apparatus of the invention; and FIG. 8 is a vertical sectional view taken along the line B—B of FIG. 7.

Figure 3:
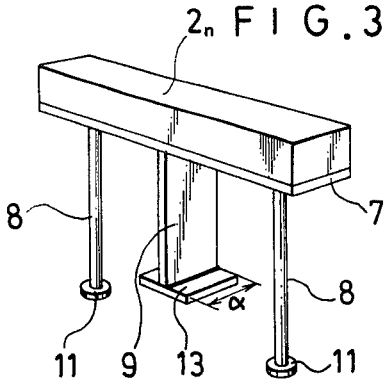
FIG. 3 is a perspective view of a mattress element.
Figure 4:
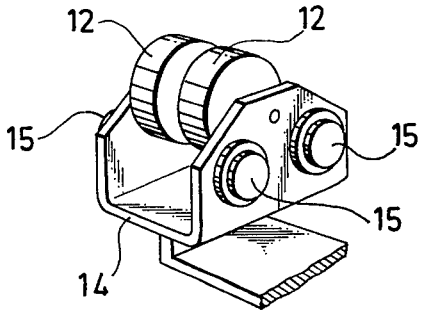
FIG. 4 is a perspective view of a weight roller assembly.

Referring to the drawings, a bed frame 1 is shown supporting a mattress as divided into a plurality of mattress elements $2_1$–$2_n$ of the construction to be described later. A patient 3 lies in a recumbent position on the assemblage of elements $2_1$–$2_n$. The arms of a nurse or attendant are indicated 4, one of the arms being inserted through a ring-shaped top 6 of an operating lever 5. Each of the mattress elements $2_1$–$2_n$ is reinforced with a steel plate 7 attached to its underside, and a pair of guide bars 8 and a plate 9 are secured at one ends to this plate and are held perpendicularly thereto. The guide bars 8 extend downwardly through the bed frame 1, and their exposed portions between the upper surface of the bed frame 1 and each steel plate are surrounded by coiled compression springs 10, which bias the plate and the associated one of the mattress elements $2_1$–$2_n$ upwardly. A stopper 11 is fixed to the lower end of each guide bar 8 to limit the rise of the mattress element to a preselected height or position. To the lower end of the plate 9 is secured, at right angles thereto, a plate 13 to serve as part of the track for weight rollers 12 to be described below. Although FIG. 3 shows the plate 13 with a width $\alpha$ substantially the same as that of each mattress element, the sameness in width is not essential. A U-shaped carriage body 14 accommodates a pair of weight rollers 12, which are spaced apart in parallel to receive the plate 9 of each mattress element in between and are rotatably carried by axles secured to the both upstanding walls of the carriage body. On the outer sides of the upstanding walls are also carried rotatably four stepped rollers 15, two in tandem on each side, in such a manner that they can rotate inside the open ends of channel bars 1' constituting the bed frame 1. The operating lever 5 is fixed at the lower end to the underside of the carriage body 14, so that moving the operating lever 5 causes the carriage body 14 and weight rollers 12 to move longitudinally of the frame 1 by means of the rollers 15.

When the weight rollers 12 are not resting on any plate 13 at the foot of any of the mattress elements $2_1$–$2_n$, the elements are all in the raised position, providing an even mattress surface, because they are pushed upward by the compression springs 10 but their ascent is limited by the stoppers 10. Each spring 10 must be designed to have a spring force greater than the downward force to be exerted by the sum of the weight of each mattress element and the weight of the patient 3 as distributed among the individual elements.

Figure 5:
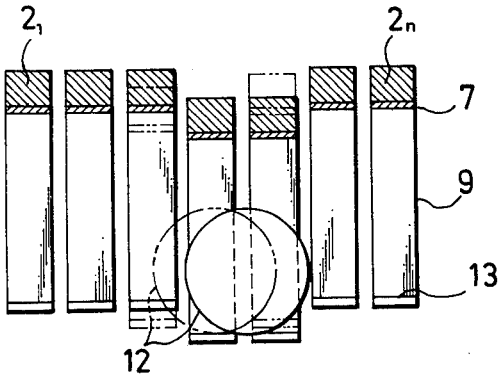
FIG. 5 is a side view of a plurality of mattress elements in use.
Figure 6:
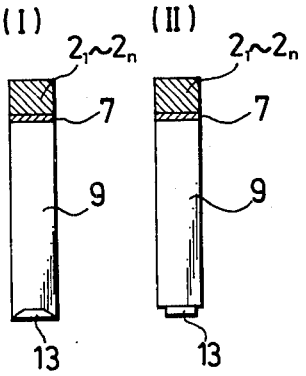

FIG. 5 shows now the mattress elements $2_1$–$2_n$ are lowered according to the movement of the weight rollers 12, the changes in height and position being indicated by full lines and alternate long and two short dashes lines. The weight rollers 12 themselves move little in the vertical direction, since the associated rollers 15 run inside the channel bars 1' of the bed frame 1. Thus, the sinkage of the mattress elements $2_1$–$2_n$ depends upon the diameter of the weight rollers 12 that depress the track plates 13 and upon the location of the plates 13. The contour of the plates 13, which is flat in FIG. 3, may be trapezoidal instead, as depicted in FIG. 6(I), to help the weight rollers 12 to easily run onto the individual plates 13. It is further possible to reduce the width $\alpha$, as in FIG. 6(II), to retard the timing for descent and quicken the timing for ascent of the mattress elements $2_1$–$2_n$.

Figure 1:
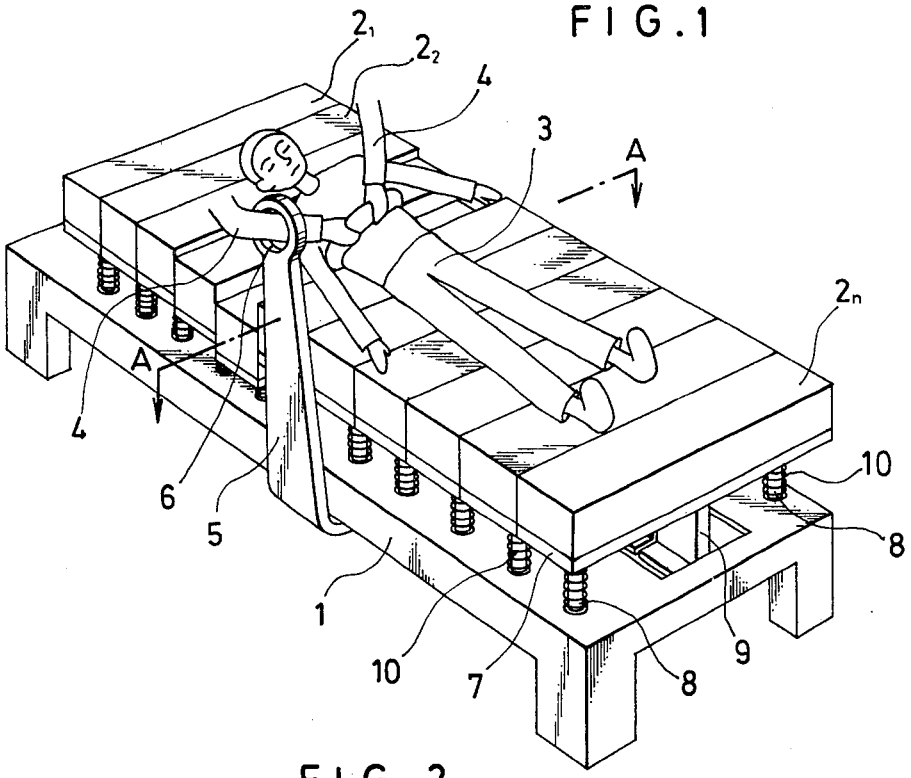
FIG. 1 is a perspective view of a dressing-undressing apparatus embodying the invention.
Figure 2:
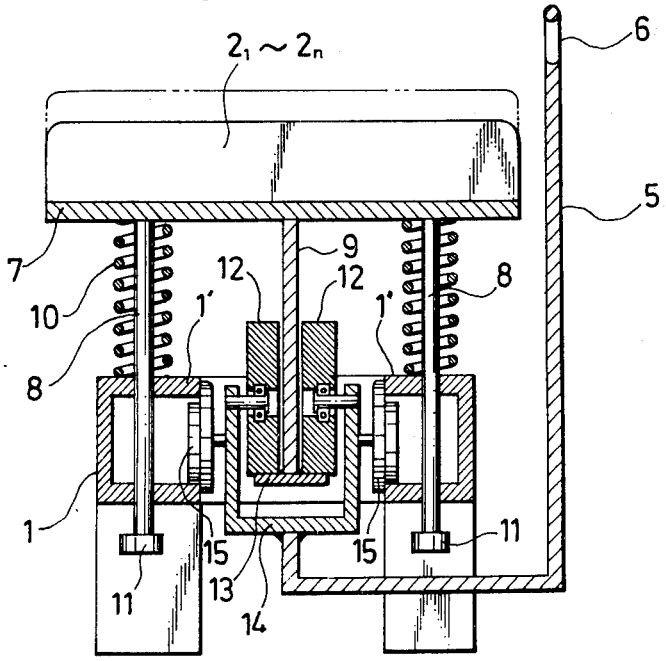
FIG. 2 is a vertical sectional view taken along the line A—A of FIG. 2.

The operation of the apparatus will now be explained. As the nurse puts his or her arm 4 through the ring 6 of the operating lever 5 and forces the lever longitudinally of the bed frame 1, the weight rollers 12 will run onto the successive plates 13 of the mattress elements $2_1$–$2_n$, and depress the plates 13 one after another. The combined spring force of the pair of compression springs associated with each mattress element is counteracted by the weight of the weight rollers 12 (plus the weights of the operating lever 5, carriage body 14, and rollers 15 in the embodiment being described, although such weights need not be taken into account in other embodiments) and the downwardly directed partial force exerted by the rotation of the weight rollers. Consequently, the particular one of the mattress elements $2_1$–$2_n$ in that location sinks as illustrated in FIG. 1. As the operating lever 5 is moved in the manner described, the space provided under the back of the lying patient 3 is shifted in succession endwise according to the fall and rise of the neighboring mattress elements. The weight rollers 12, when not in use, may be kept in the head or foot end portion of the bed frame 1.

FIGS. 7 and 8 show another embodiment of the invention in which the mattress elements are in the form of air sacs. To the underside of each air-sac element 16 is secured a directional control valve 17 through a pipe 18. The valve 17 functions so that, when a cam 19 provided halfway up the operating lever 5 pushes a lever 20 of the valve, it cuts off the communication between the air-sac element 16 and a pump 21 and establishes communication between the element and the piping of a vacuum pump 22, whereby the element is rapidly deflated by evacuation. The lower end of the operating lever 5 is integrally provided with a guide plate 24 carrying rollers 23. These rollers 23 are adapted to run along grooves or rails 25 formed on the same side of the bed frame 1 to permit the operating lever 5 and cam 19 to move together only along the restricted horizontal path without any upward or downward motion.

As has been described in detail, the component elements of a mattress can be lowered one after another, in accordance with the invention, by the movement along guide rails of an actuating mechanism connected to an operating member which a nurse manipulates by putting one of his or her arms through a ring-shaped top of the operating member. The nurse is now free to extend the both arms, when need arises, into the resulting space between the lowered mattress element and the back of the patient, and single-handedly dress or undress a bedfast patient who is unable to move himself. The procedure is no longer a hard labor for the nurse, and there is no back strain problem. The shiftable space formed between the mattress and the lying patient provides an easy access to all of the patient's body, enabling the nurse to care for the patient, for example, by cleaning his body with wet towel following the undressing or when changing the cloths. The present invention is advantageously applicable to special beds for the handicapped as well as the elderly confined to bed for long periods.

What is claimed is:

1. A dressing-undressing apparatus comprising a bed frame, a plurality of mattress elements arranged parallelly in a row to form a mattress on said bed frame, said mattress elements being adapted to rise and fall or sink individually, a guide assembly mounted longitudinally of said bed frame, an actuating mechanism adapted to travel along said guide assembly to raise or lower said mattress elements individually, and an upright operating lever secured at the lower end to said actuating mechanism and having a ring formed at the upper free end through which the nurse can put one of his or her arms.

2. A dressing-undressing apparatus as defined in claim 1, wherein each said mattress element has guide bars and a plate all secured at one ends to the underside of said element and extended vertically downward, stoppers and a weight-roller track plate are horizontally fixed, respectively, to the lower ends of said guide bars and plate, said guide bars and plate being extended through said bed frame, and compression springs are interposed between said mattress elements and said bed frame to support said elements flush with one another on said bed frame, while said actuating mechanism including weight rollers is movably engaged with channel bars disposed longitudinally of said bed frame, said weight rollers being adapted to run along said weight-roller track plates of said mattress elements.

3. A dressing-undressing apparatus as defined in claim 1, wherein said mattress elements are in the form of air sacs, which are connected to a pump and a vacumm pump through directional control valves, in such a way that each said air-sac mattress element can be connected to said vacuum pump by actuating a change lever of the associated directional control valve by means of a cam of said actuating mechanism.

* * * * *